US005560312A

United States Patent [19]

McPherson

[11] Patent Number: 5,560,312

[45] Date of Patent: Oct. 1, 1996

[54] FENDERS FOR WATERCRAFT

[76] Inventor: Sarah A. McPherson, Rte. 1, Box 609 B, Finger, Tenn. 38334

[21] Appl. No.: 546,033

[22] Filed: Oct. 20, 1995

[51] Int. Cl.[6] ..... B63B 59/02

[52] U.S. Cl. ..... 114/219; 114/361

[58] Field of Search ..... 114/219, 220, 114/361

[56] References Cited

U.S. PATENT DOCUMENTS

| | | | |
|---|---|---|---|
| 2,606,755 | 8/1952 | Samuels | 114/219 |
| 5,095,840 | 3/1992 | Kramer | 114/219 |
| 5,127,354 | 7/1992 | Magrab et al. | 114/219 |
| 5,184,562 | 2/1993 | Hallin | 114/219 |
| 5,299,521 | 4/1994 | Loucks | 114/219 |
| 5,355,822 | 10/1994 | Lemke | 114/219 |
| 5,361,715 | 11/1994 | Kiedaisch et al. | 114/219 |

FOREIGN PATENT DOCUMENTS

| | | | |
|---|---|---|---|
| 2841272 | 6/1979 | Germany . | |
| 5534940 | 3/1980 | Japan . | |
| 5016877 | 1/1993 | Japan | 114/219 |
| 994337 | 2/1983 | U.S.S.R. . | |
| 2129376 | 5/1984 | United Kingdom . | |

*Primary Examiner*—Jesus D. Sotelo
*Attorney, Agent, or Firm*—Peter Loffler

[57] ABSTRACT

Swim platforms extending from relatively larger boats are often used by operators of personal watercraft (e.g., Jet Ski™) for boarding such larger boats. The hard structure of a swim platform, in combination with the relatively unprotected edge or gunwale of the personal watercraft hull, can lead to at least cosmetic damage to the watercraft superstructure as it contacts the swim platform, particularly if the relatively low watercraft is tossed or rolled beneath the swim platform due to wave or wind action. The present fenders for watercraft provide temporarily installable and removable pads or fenders for swim platforms and for personal watercraft, to preclude such damage. The fenders include closed cell foam cores with synthetic fabric covering, and in at least one embodiment, are foldable for compact storage in the watercraft. The attachments ensure that the fenders cannot move relative to the attachment edge, in order that they cannot float up to expose an unprotected edge or surface. Yet, at least the swim platform fender may be pushed beneath the swim platform to remain between the hull of a watercraft and the hard underside of the swim platform, thereby protecting the watercraft from damage.

18 Claims, 3 Drawing Sheets

FENDERS FOR WATERCRAFT

FIELD OF THE INVENTION

The present invention relates generally to pads and protective covers for various articles and objects, and more specifically to bumper pads (generally called "fenders" in the maritime environment) for watercraft. The present fenders include means providing for attachment to the swim platform of a boat, or to a personal watercraft (e.g., Jet Ski™) and precluding shifting of the pad relative to the boat or watercraft. At least one of the fender embodiments may be foldable for compact storage within the storage compartment generally provided with personal watercraft.

BACKGROUND OF THE INVENTION

Fenders for boats and ships have generally been known for quite some time, and were developed to preclude damage to the hull or gunwale of a boat or ship tied up to a dock or pier or to another ship. The forces which may develop between adjacent ships, or between ship and pier, due to wave, wind, and tidal action can be enormous and can result in substantial damage to the ship and/or adjacent structure, perhaps even causing the hull of the ship to be punctured and/or the pier to be substantially damaged over a period of time of constant friction and interference between the ship and other structure. The fenders which have been developed in response to this problem, generally allow a fair amount of movement between ship or boat hull and adjacent structure, without damage to either. In fact, the fenders are generally suspended from the ship or structure, and are allowed a fair amount of movement, to absorb the relative movement between ship or boat and adjacent structure.

More recently, a relatively new class of very small personal watercraft has been developed, which may seat only one or two riders and which ride very low on the water. Examples of such craft are the Sea-Doo™ manufactured by the Bombardier Company of Canada, and the Jet Ski™. Such personal watercraft are generally considered the approximate equivalent of waterborne motorcycles, and are generally powered by small but powerful inboard engines completely enclosed in the hull and small superstructure. The maximum dimensions of the hull of such craft, at what might be considered the equivalent of the gunwale between hull and superstructure, is generally only some six to eight inches above the waterline.

As such craft ride very low in the water, ease of access to larger boats is somewhat limited. Often, the only convenient point to tie up and board a larger boat from a personal watercraft, is by means of the swim platform of such a boat, if so equipped. Quite often, larger boats and yachts are equipped with such a swim platform, which enables a swimmer to stand only a foot or so above the water level, rather than having to dive from the boat rail some several feet to the water, and to climb back up the side of the hull several feet to board the boat after swimming.

However, such swim platforms were never originally intended to provide for the securing of another small boat or personal watercraft thereto, however convenient they may be for such use. Swim platforms generally have relatively hard edges and corners to provide a good grip for swimmers, and such features can cause substantial damage, at least cosmetically, to the gel coat finishes of fiberglass watercraft structures when such a watercraft is secured to a swim platform.

Generally, swim platforms are not provided with any fenders, as they were never intended for securing another boat thereto. Similarly, personal watercraft are generally provided with only a simple rub strip of limited resilience along the gunwale, just above the waterline. This relatively narrow protective strip is incapable of protecting a personal watercraft from damage from the edge of another relatively narrow structure, such as the edge of a swim platform, when the craft and platform are in relative motion to one another due to wave and wind action. The motions may be relatively small, due to the small sizes of the two craft, but nevertheless will allow at least a portion of the hull of a watercraft to drift under the platform, where the upper portion of the watercraft hull can be damaged substantially, at least cosmetically.

Accordingly, a need will be seen for fenders for watercraft, which are removably but substantially immovably attachable to various watercraft structures to preclude their floating and shifting to expose the underlying structure. In one embodiment, the fenders must be adapted to provide for removable attachment to different types of swim platforms, and must not allow relative shifting of position between fender and platform. In another embodiment, the fender must be adapted for removable attachment to a personal watercraft, such as a Jet Ski™, again with means provided to preclude movement of the fender relative to the watercraft. At least the personal watercraft fender embodiment must also be foldable, in order to provide for compact storage within the conventional storage compartment of such personal watercraft.

DESCRIPTION OF THE PRIOR ART

U.S. Pat. No. 5,095,840 issued to James H. Kramer on Mar. 7, 1992 describes Fender Protective Structures comprising a relatively hard outer material, a softer intermediate material, and a rigid backing plate. The present fenders use a relatively soft closed cell foam material internally, with a synthetic fabric cover on both sides thereof, and hence are completely flexible and in fact may be folded in at least one embodiment. Moreover, the Kramer fender is permanently secured to the boat or other structure to which it is adapted, whereas the present fenders are removably secured to the adjacent structure in each embodiment.

U.S. Pat. No. 5,127,354 issued to Edward B. Magrab et al. on Jul. 7, 1992 describes an Energy Absorbing System comprising a series of concentric compressible units. The present fenders comprise only a single layer of resilient material. The Magrab et al. system is generally in the form of a cylindrical structure, which projects outwardly from the structure to which it is permanently attached. The present fenders are relatively thin and continuous structures, removably secured to a watercraft.

U.S. Pat. No. 5,184,562 issued to Mark P. Hallin on Feb. 9, 1993 describes a Lake Dock Pole Accessory System, comprising a plurality of sleeves which fit around a respective plurality of dock posts. At least the bumper portion is formed of wood, which material is relatively heavy and rigid and not suitable for the environment of the present fenders, wherein such fenders are temporarily securable to a watercraft and may be easily removed and stored as desired. The Hallin fenders are permanently installed upon the dock poles by means of set screws, and completely surround the poles, unlike the present fenders.

U.S. Pat. No. 5,299,521 issued to Jerry T. Loucks on Apr. 5, 1994 describes a Bumper Protector For A Watercraft, which device is essentially a sheet of impervious material such as rubber or the like with a series of ribs on the back or inside surface. The device may be temporarily secured along the gunwale of a boat by means of suction cups, which serve to preclude movement of at least a portion of the device relative to the underlying surface to which it is attached. However, the device is relatively bulky and heavy, and the only provision made for compact storage is by rolling the device, as opposed to the flat folding provided in at least some embodiments of the present fenders; the Loucks pad cannot be folded, due to the relatively rigid ribs on the back thereof. The present fenders are much lighter, being formed of foam material and fabric covering, and the hook and loop fastening means and/or straps, are much more reliable than suction cups for attachment to another object. Moreover, the Loucks pad must be secured about both sides of a gunwale or other structure, whereas the present fenders are adapted to secure to only the outer surface of a watercraft or watercraft structure.

U.S. Pat. No. 5,355,822 issued to Stuart H. Lemke on Oct. 18, 1994 describes a Bumper Fender having a low friction slip sheet adapted to contact the dock, and an underlying cushion sheet installed loosely therebehind. The cushion sheet of Lemke is free to move somewhat relative to the overlying slip sheet, unlike the completely contained cushion pad within the present fenders. The Lemke pad cannot be folded, due to the reinforcement rod installed along the upper edge. The present fenders are at least flexible in all dimensions, if not completely foldable.

U.S. Pat. No. 5,361,715 issued to Edward Kiedaisch et al. on Nov. 8, 1994 describes a Marine Dock Fender Contact Surface Attaching Boss, comprising a pair of cantilever supports extending outwardly from a dock structure or the like, with a rigid, flat pad permanently secured thereto. The entire assembly is permanently secured to the supporting structure by threaded fasteners, unlike the removable fenders of the present invention. Moreover, the Kiedaisch et al. fender could not be folded, even if it could be removed, as provided by the present fenders in at least one embodiment thereof.

German Patent Publication No. 2,841,272 to Eberhard Muller et al. and published on Jun. 28, 1979 describes a roller fender for docks and maritime use, wherein a cylindrical resilient fender is secured to a vertical axle to allow the fender to rotate thereabout. The entire apparatus is permanently installed to a dock or the like, and is not removable. The round structure precludes folding, as provided by at least one embodiment of the present fenders.

Japanese Patent Publication No. 55-34,940 published on Mar. 11, 1980 describes an air float type maritime fender, wherein a generally cylindrical float with a hemispherical end is formed. The end is removed and reversed to a concave shape to mate with a cooperating convex hemispherical end of another float for the assembly thereof. No fender comprising a flat, planar, continuous sheet of material is disclosed, nor is any removable fender disclosed in the Japanese patent publication, as provided by various embodiments of the present fender. As in the case of the round structure of the German patent publication discussed above, the Japanese fender cannot be folded.

Soviet Patent Publication No. 994,337 published on Feb. 7, 1983 describes a pneumatic fender for a ship, comprising a series of inflated toroid shapes in a resilient cylindrical container. The container and the toroids therein are inflated higher than ambient pressure. The cylindrical shape of the device is similar to many well known, but more simply constructed, maritime fenders, and precludes folding or compact storage as provided by the present fenders. Moreover, the device is not immovably affixed to a boat or other structure at any point, as provided by the present fenders, and cannot be disposed continually along an edge or gunwale.

Finally, British Patent Publication No. 2,129,376 to John Hartwall and published on May 16, 1984 describes a Fender Holder comprising a plurality of generally cylindrical wire baskets which may be connected together parallel to one another, but with different angles through an axis across their joined dimension. No fenders are disclosed. The holders are adapted to be clamped to an underlying tubular structure (railing, etc.) by threaded fasteners, unlike the snap or hook and loop fastening means provided with the present fenders, which precludes any requirement for tools. The generally cylindrical wire basket configuration is relatively bulky, and precludes folding. The cylindrical fenders which would apparently be contained in the holders, cannot be disposed along an edge in a continuous, unbroken line, as provided by embodiments of the present fenders.

None of the above noted patents, taken either singly or in combination, are seen to disclose the specific arrangement of concepts disclosed by the present invention.

SUMMARY OF THE INVENTION

By the present invention, improved fenders for watercraft are disclosed.

Accordingly, one of the objects of the present invention is to provide improved fenders for watercraft which include embodiments adapted for removable installation to a swim platform of a boat and to the side or gunwale of a personal watercraft.

Another of the objects of the present invention is to provide improved fenders for watercraft which are adapted to extend continually in an unbroken line or sheet along the side or edge of a swim platform or personal watercraft.

Yet another of the objects of the present invention is to provide improved fenders for watercraft which are temporarily and removably securable to a swim platform or personal watercraft along at least one attachment edge or line, but which are precluded from movement relative to the attachment edge or line.

Still another of the objects of the present invention is to provide improved fenders for watercraft which include a closed cell foam core and a synthetic fabric covering.

A further object of the present invention is to provide improved fenders for watercraft which are foldable for compact storage in at least one embodiment.

An additional object of the present invention is to provide improved fenders for watercraft which may include strap attachment means in addition to hook and loop or snap attachment means.

Another object of the present invention is to provide improved fenders for watercraft which strap attachment means may include adjustment means and weight means thereon, to provide for ease of strap installation.

A final object of the present invention is to provide improved fenders for watercraft for the purposes described which are inexpensive, dependable and fully effective in accomplishing their intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
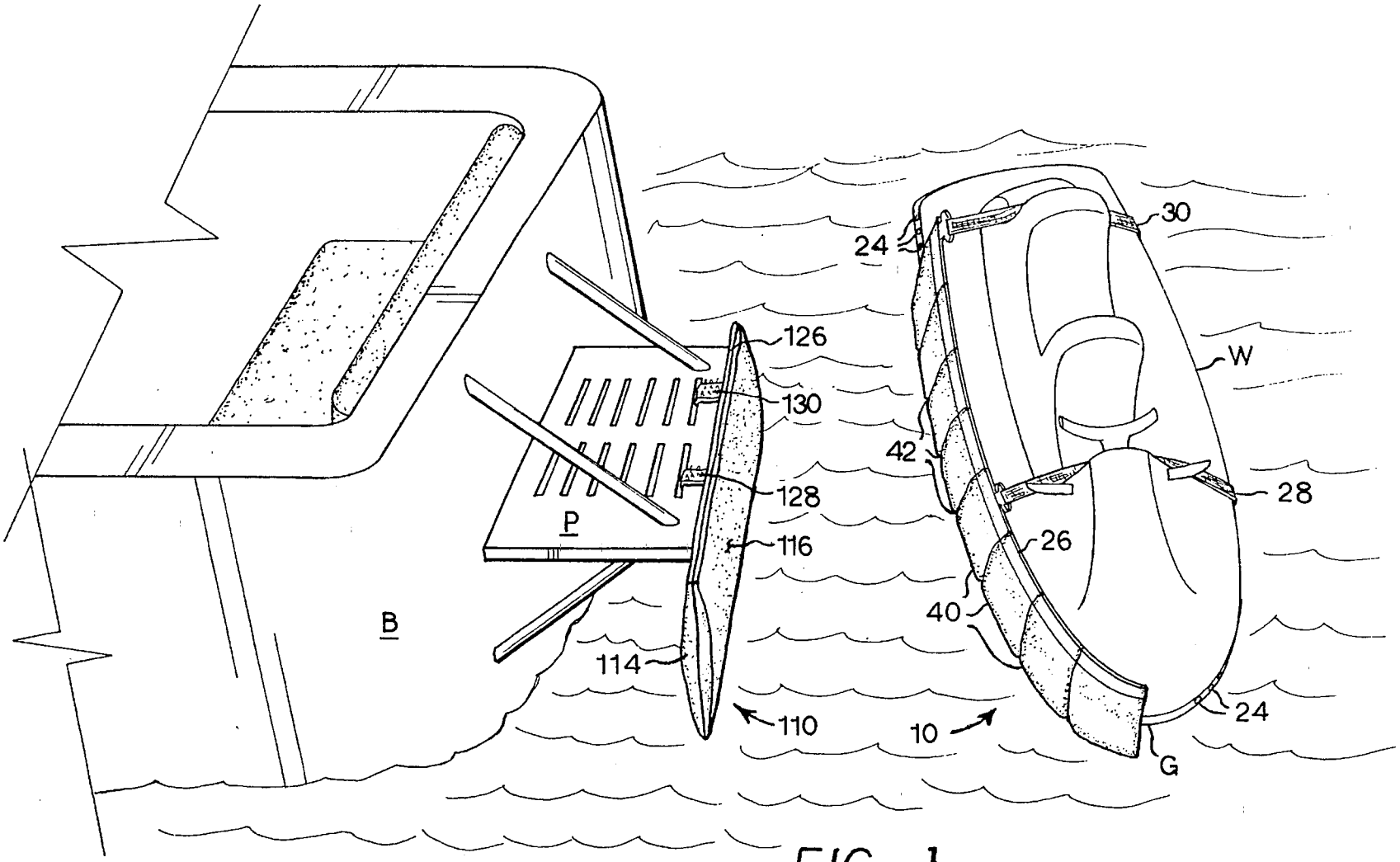
FIG. 1 is a perspective view of a swim platform fender and a personal watercraft fender of the present invention, removably installed upon their respective vessels.

Referring now particularly to FIG. 1 of the drawings, the present invention will be seen to relate to various embodiments of fenders for personal watercraft (e.g., Jet Ski™, and Sea-Doo™, as well as others) and for a swim platform extending from a larger boat. The relatively low swim platform of a boat provides a most convenient point for the docking of a smaller personal watercraft, when the operator of such a personal watercraft wishes to visit a larger swim platform equipped boat. However, such swim platforms are typically constructed of a relatively hard, non-resilient and often abrasive material, in order to provide a good grip for swimmers. The relatively narrow resilient rub strip generally provided along the gunwale or widest point of the hull of a personal watercraft, does little or nothing to prevent contact of various other portions of the hull of the watercraft with the edges of a swim platform to which the watercraft may be secured.

Figure 2:
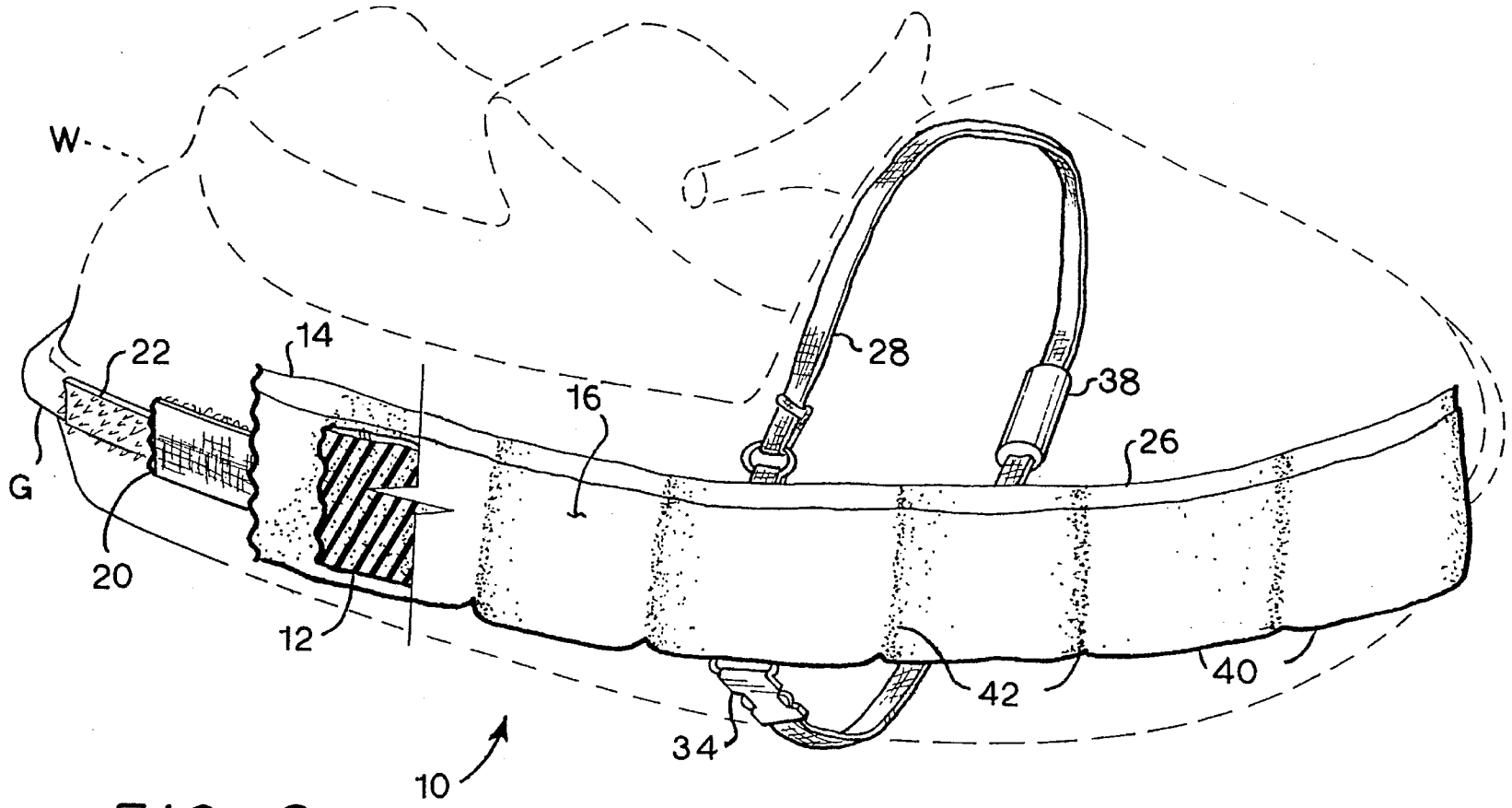
FIG. 2 is a partially broken away perspective view of a personal watercraft fender, showing its construction and attachment means to a personal watercraft.

Accordingly, a fender 10 adapted to be removably attached to a personal watercraft W, serves to protect the hull of such a watercraft W in a substantially continuous and unbroken length therealong, on one or both sides, as desired. Details of the construction and removable installation of such a personal watercraft fender 10, are shown in FIG. 2. The fender 10 generally comprises a relatively thin, wide, and elongate pad, with a central core of resilient material 12 (preferably a closed cell foam material, in order to obviate water absorption) serving as the primary member of the fender 10. While the pad 12 is relatively thin in comparison to many other maritime fenders and bumpers, it is preferably sufficiently thick as to provide good cushioning characteristics.

Figure 3:
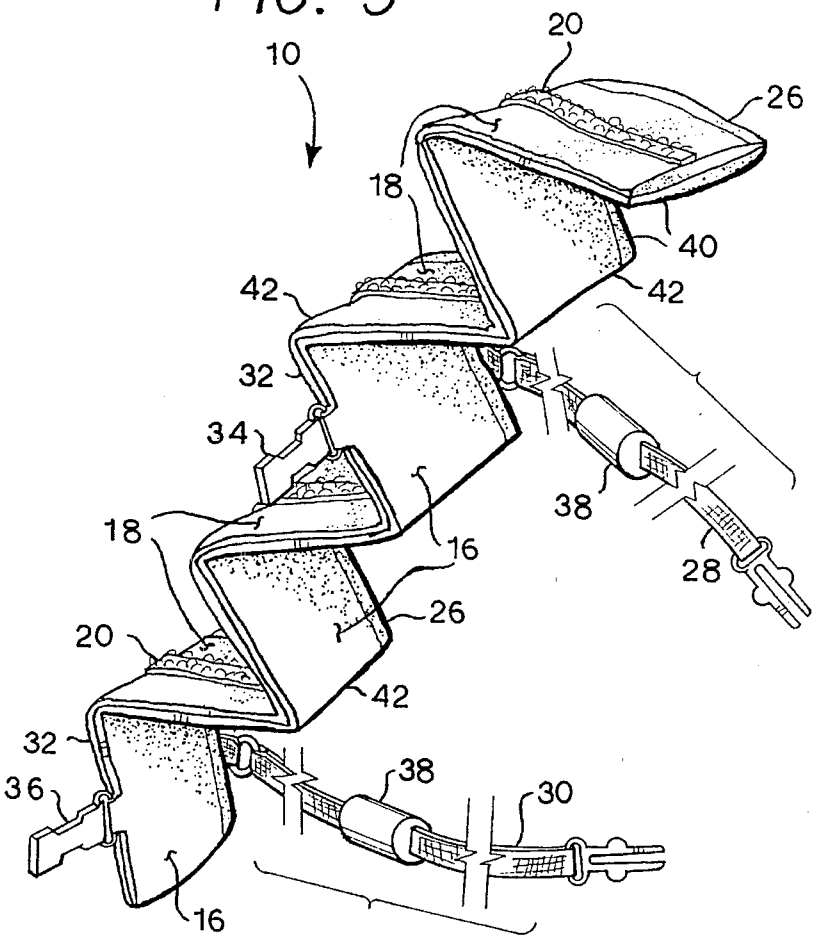
FIG. 3 is a perspective view of a partially folded personal watercraft fender, showing further structural details thereof.

The central core 12 is completely enclosed by a thin, flexible cover 14, which may be formed of any suitable material. Preferably, the cover 14 is formed of a synthetic fabric material having good durability and resistance to ultraviolet and other environmental hazards. A Nylon™ taffeta or heavy gauge of rip stop fabric has been found to work well for the present cover 14. The watercraft fender 10 includes an outwardly facing working surface 16 and an opposite, inwardly facing (i.e., toward the watercraft W) surface 18, both more clearly shown in the partially folded fender 10 of FIG. 3. The inwardly facing surface 18 includes some form of watercraft attachment means thereon, such as the strip of hook and loop fastening material 20 (e.g., Velcro™) installed generally medially on the attachment surface 18 and in a continuous, unbroken line therealong. The watercraft W thus includes a complementary, mating strip of hook and loop material 22 permanently installed to the gunwale G, and providing for the removable attachment of the fender 10 as desired. Alternate attachment means may be provided, such as a continuous string of snap fasteners 24 (FIG. 1) disposed along the gunwale G, with complementary mating snaps installed along the attachment surface 18 of the fender 10.

It will be seen that the use of hook and loop fastening material, or snap fasteners, serves to secure the fender 10 to the watercraft W so that the fender attachment line (as defined by the fastener material) cannot move relative to the underlying gunwale or attachment surface. Thus, the present fender 10 cannot float upward or be weighed downward, to expose the gunwale or other watercraft hull surface protected therebehind, as may be the case with simple loose ties often used in prior art fenders.

Additional security for the present fender 10 may be provided by a pair of straps adapted to pass around the hull of the watercraft W. The upper edge 26 of the fender 10 may include an adjustable forward strap 28 and an adjustable rearward strap 30 extending therefrom, with the lower edge 32 of the fender 10 having a forward buckle or attachment 34 and a rearward attachment buckle 36 extending therefrom. The forward strap and buckle 28 and 34 and the rearward strap and buckle 30 and 36 provide for the removable securing of the straps 28 and 30 about the hull of the watercraft W, to provide additional security for the fender 10 installation. The forward and rearward straps 28 and 30 may also each include a weight 38 installed thereon or therein, with the weights 38 providing sufficient density to cause the straps to sink, rather than floating atop the water as the fender 10 is installed upon the watercraft W. The relatively heavy straps 28/30, with their weights 38, may then be easily maneuvered beneath the watercraft hull, for attachment to their respective buckles 34 and 36.

The present personal watercraft fender 10 is also adapted for compact storage, as in the storage compartment of a personal watercraft W. It will be noted that the core material 12 and cover 14 of the fender 10 are divided into a plurality of substantially equal sized segments 40, as indicated by the division lines 42 shown in the cover 14 overlying the core 12 and its segments 40. Thus, the fender 10 may be folded alternatingly back and forth to provide for compact storage thereof, The straps 28/30 may be wrapped or otherwise secured about the folded segments 40 of the fender 10, to secure the fender 10 for storage in a watercraft storage compartment or otherwise, as desired.

FIG. 1 also discloses a swim platform fender 110, generally approximating the construction and configuration of the personal watercraft fender 10 discussed above. The swim platform fender 110 is adapted to be secured to a swim platform P, extending from a larger boat B. As noted above, such swim platforms P provide very convenient docking facilities for a relatively small and low watercraft, such as the personal watercraft W of FIG. 1, but due to the typical swim platform construction, a watercraft W can easily be rolled partially beneath the platform P by wind and wave action, and the hardware and other rigid construction of the platform P can inflict damage to the gel coat or other finish of the watercraft W. The provision of a swim platform fender 110, serves to prevent any portion of the watercraft W coming into direct contact with the platform P itself.

Figure 4:
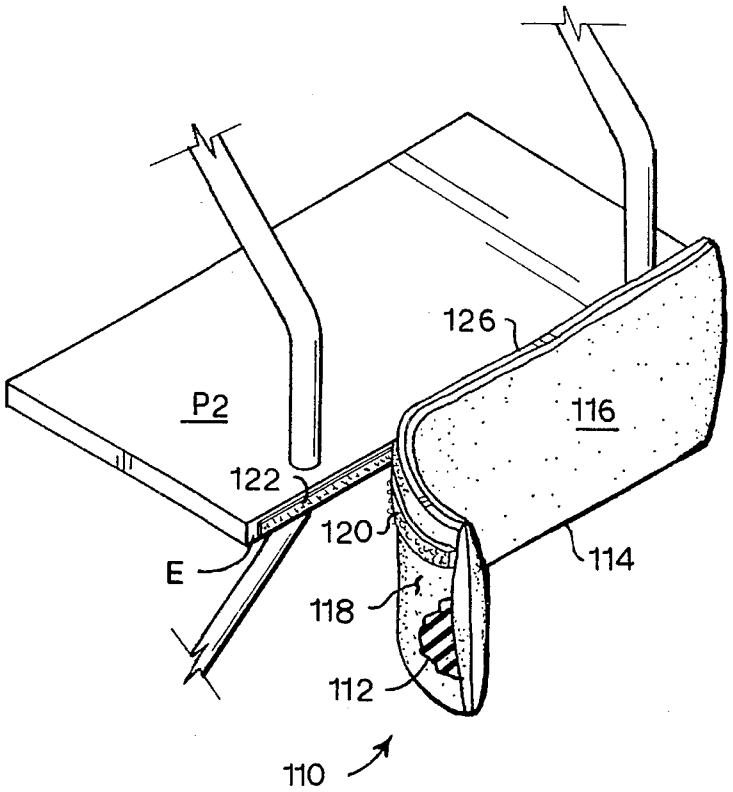
FIG. 4 is a perspective view of an alternate embodiment of the swim platform fender of FIG. 1, showing an alternate means of temporary and removable attachment.

The swim platform fender 110 includes a central core of resilient material 112 (preferably a closed cell foam), and a thin, flexible outer covering 114 completely surrounding and enclosing the core 112. The cover 114 is preferably a synthetic fabric (e.g., Nylon™, in a taffeta or rip stop weave), and includes an outer working surface 116 and an opposite attachment surface 118, as in the watercraft fender 10 discussed above; FIG. 4 provides a detailed view of these components.

Swim platforms may comprise different configurations, such as the built up platform P of FIG. 1, wherein a plurality of members (e.g., mahogany or teak wood, etc.) are assembled with spacers of like material therebetween, to provide slots for drainage in the platform P. FIG. 4 discloses a different type of platform, designated as P2, wherein the platform P2 comprises an unbroken sheet of material (generally fiber glass or other plastic material).

As the swim platform P2 of FIG. 4 does not provide any slots or passages therethrough for straps or other like attachment means, the swim platform fender 110 of FIG. 4 includes a fender attachment flap 120 extending from the attachment surface 118 and adjacent and parallel to the upper edge 126 thereof, with the flap 120 including a strip of fastening material 121 therealong. The upper surface U of the platform P2 includes a mating strip of fastening material 122 disposed therealong and adjacent or near the edge E of the platform P2. The material 121/122 may be hook and loop fastening material disposed in a continuous, unbroken line along the attachment flap 120 of the fender 110 and the upper surface U of the platform P2 adjacent the attachment edge E thereof, or may alternatively be some other form of attachment, such as the snaps 24 used as an alternative attachment for the watercraft fender 10 and disclosed in FIG. 1.

The slotted configuration of the swim platform P of FIG. 1, provides an alternative means for the attachment of a swim platform fender 110 thereto. In FIG. 1, the swim platform 110 includes a first and a second swim platform attachment strap 128 and 130, installed to the fender 110 near the upper edge 126 thereof. These straps 128/130 may include hook and loop fastening means thereon, or some alternative fastening means (snaps, buckles, etc.) as desired. Preferably, the fastening means used should allow the fender 110 to be secured relatively tightly to the swim platform P, in order to preclude movement of the fender 110 along its swim platform attachment line (defined by the straps 128 and 130) relative to the attachment edge of the swim platform P (similar to the attachment edge E of FIG. 4, but not necessarily including other attachment means thereon.) Thus, the fender 110 may be pushed beneath the swim platform P/P2, between the platform and a watercraft W, but cannot be lifted away from its attachment edge or line with the swim platform, to expose the swim platform.

In summary, the various embodiments of the present personal watercraft fenders 10 and swim platform fenders 110, will be seen to provide needed protection for personal watercraft and other small, low boats and watercraft. The fender 10 is particularly adapted for use with personal watercraft such as Ski-Doos™ and Jet Skis™, but may be adapted to other types of small watercraft (sailboats, etc.) as well. The use of such a fender 10 on a personal watercraft permits a wide latitude of docking and mooring possibilities for such watercraft, which before were limited due to concern for possible damage to such watercraft due to the very limited protection provided by the relatively narrow rub strip typically disposed along the gunwale of such craft.

Additional protection for such personal watercraft, as well as other relatively small boats, is provided by the swim platform fender 110 in its various embodiments. As swim platforms typically installed on many larger boats are often used to moor smaller craft to the larger boat, the provision of a fender 110 particularly adapted for installation to such a platform solves the problem of potential damage to such smaller craft due to contact with the hard structure of such platforms. While the larger craft with which such swim platform fenders may be used will typically have sufficient storage space for such a fender without need to fold or otherwise compress the fender, it will be seen that the folding capability provided for compact storage of the personal watercraft fender 10 may also be provided with the swim platform fender 110, as the two fenders 10/110 are similarly constructed.

In any case, a critical feature of the present fenders 10/110 in either their personal watercraft or swim platform embodiments, is that the fastening means provided, precludes any motion of the fenders 10/110 along an attachment edge and relative to an adjacent attachment edge of the watercraft or swim platform to which the fender is removably attached. (The swim platform fender embodiments may swing arcuately beneath a swim platform to which they are secured if contacted by a watercraft, but the attachment line of the fender and attachment line of the swim platform, will remain fixed relative to one another due to the tight but removable attachment means provided. Thus, the swim platform fender will automatically remain positioned between swim platform and watercraft, in order to provide protection for the watercraft.)

It will also be seen that both sides of a watercraft may be protected by securing a fender to each side, and that such fenders may be made to be symmetrical to provide greater versatility, if desired. Alternate storage means may also be provided, such as a storage and carriage bag, if desired, for greater versatility. The user of the present fenders may easily carry one or more wherever he or she is involved with boating, to protect the craft being used from costly cosmetic or structural damage, from whatever cause, while on the water.

It is to be understood that the present invention is not limited to the sole embodiments described above, but encompasses any and all embodiments within the scope of the following claims.

I claim:

1. A fender for a watercraft, comprising:

a thin, wide, and elongate pad having an inwardly facing attachment surface and an opposite outwardly facing surface, and adapted to extend in a continuous, unbroken length along an attachment edge of a watercraft structure;

said pad comprising a core of resilient material and a thin, flexible cover completely surrounding said core, said core of resilient material being divided into a plurality of separate segments of substantially equal size, and said cover including a division between each of said core segments and is foldable along each said division;

said attachment surface of said fender including attachment means thereon defining a fender attachment line and adapted to attach said fender removably along the attachment edge of the watercraft structure so that said attachment line of said fender is precluded from movement relative to the attachment edge of the watercraft structure to which said fender is removably attached, whereby;

said fender is removably attached along the attachment edge of the watercraft structure as desired by said attachment means of said attachment surface of said fender, and serves to protect the watercraft structure from damage due to contact with other objects and further to protect other watercraft from damage due to contact with the watercraft to which said fender is removably attached.

2. The watercraft fender of claim 1, including:

cooperating attachment means disposed in a continual length along the watercraft attachment edge, and said attachment means of said fender further comprising a continual length.

3. The watercraft fender of claim 2, wherein:

said attachment means of said fender and said cooperating attachment means of the watercraft attachment edge, each comprise an unbroken length of cooperating hook and loop fastening material.

4. The watercraft fender of claim 2, wherein:

said attachment means of said fender and said cooperating attachment means of the watercraft attachment edge, each comprise a line of cooperating snap fasteners.

5. The watercraft fender of claim 1, wherein:

said core of resilient material is a closed cell foam plastic material.

6. The watercraft fender of claim 1, wherein:

said thin, flexible cover is Nylon fabric material.

7. A fender for a personal watercraft, comprising:

a thin, wide, and elongate pad having an inwardly facing attachment surface and an opposite outwardly facing surface, and adapted to extend in a continuous, unbroken length along a gunwale of a personal watercraft, with the personal watercraft gunwale defining an attachment edge for said fender;

said pad comprising a core of resilient material and a thin, flexible cover completely surrounding said core, said core of resilient material being divided into a plurality of separate segments of substantially equal size, and said cover including a division between each of said core segments and is foldable along each said division;

said attachment surface of said fender including attachment means thereon defining a fender attachment line and adapted to attach said fender removably to the gunwale attachment edge of the personal watercraft so that said attachment line of said fender is precluded from movement relative to the gunwale attachment edge of the personal watercraft to which said fender is removably attached, whereby;

said fender is removably attached to the gunwale attachment edge of the personal watercraft as desired by said attachment means of said attachment surface of said fender, and serves to protect the personal watercraft from damage due to contact with other objects and further to protect other watercraft from damage due to contact with the personal watercraft to which said fender is removably attached.

8. The personal watercraft fender of claim 7, including:

cooperating attachment means disposed in a continual length along the gunwale attachment edge of the personal watercraft, and said attachment means of said fender further comprising a continual length.

9. The personal watercraft fender of claim 8, wherein:

said attachment means of said fender and said cooperating attachment means of the gunwale attachment edge of the personal watercraft, each comprise an unbroken length of cooperating hook and loop fastening material.

10. The personal watercraft fender of claim 8, wherein:

said attachment means of said fender and said cooperating attachment means of the gunwale attachment edge of the personal watercraft, each comprise a line of cooperating snap fasteners.

11. The personal watercraft fender of claim 7, wherein:

said core of resilient material is a closed cell foam plastic material.

12. The personal watercraft fender of claim 7, wherein:

said thin, flexible cover is Nylon fabric material.

13. The personal watercraft fender of claim 7, wherein:

said fender includes an upper and an opposite lower edge, with said upper and said lower edge each having at least a forward and a rearward strap extending therefrom, with each said strap adapted to surround said watercraft to provide additional attachment security for said fender, and at least one said .forward and at least one said rearward strap including a non-buoyant weight thereon sufficient to cause said strap including said weight to sink below said watercraft to provide for ease of application of said strap about said watercraft.

14. A fender for a swim platform of a watercraft, comprising:

a thin, wide, and elongate pad having an inwardly facing attachment surface and an opposite outwardly facing surface, and adapted to extend in a continuous, unbroken length along an attachment edge of a watercraft swim platform;

said pad comprising a core of resilient material and a thin, flexible cover completely surrounding said core;

said attachment surface of said fender including an upper edge having an attachment flap extending therefrom and adjacent and parallel thereto, with said attachment flap including attachment means thereon defining a fender attachment line and adapted to attach said fender removably along the attachment edge of the swim platform so that said attachment line of said fender is precluded from movement relative to the attachment edge of the swim platform along which said fender is removably attached, whereby;

said fender is removably attached along the attachment edge of the watercraft swim platform as desired by said attachment means of said attachment flap of said fender, and serves to protect a watercraft docking with the swim platform, from damage due to contact with the swim platform.

15. The watercraft swim platform fender of claim 14, including:

cooperating attachment means disposed in a continual length along and adjacent the watercraft swim platform attachment edge, and said attachment means of said fender further comprising a continual length.

16. The watercraft swim platform fender of claim 15, wherein:

said attachment means of said fender and said cooperating attachment means along the watercraft swim platform attachment edge, each comprise an unbroken length of cooperating hook and loop fastening material.

17. The watercraft fender of claim 15 wherein:

said attachment means of said fender and said cooperating attachment means along the watercraft swim platform attachment edge, each comprise a line of cooperating snap fasteners.

18. The watercraft fender of claim 14, wherein:

said core of resilient material is a closed cell foam plastic material, and said thin, flexible cover is Nylon fabric material.

* * * * *